US005615611A

United States Patent [19]

Puschnerat

[11] Patent Number: 5,615,611

[45] Date of Patent: Apr. 1, 1997

[54] CHAMBER DOCTOR BLADE ASSEMBLY

[75] Inventor: Helmut Puschnerat, Wachenheim, Germany

[73] Assignee: Koenig & Bauer-Albert Aktiengesellschaft, Wurzburg, Germany

[21] Appl. No.: 548,188

[22] Filed: Oct. 25, 1995

[30] Foreign Application Priority Data

Oct. 26, 1994 [DE] Germany ..... 44 38 262.6

[51] Int. Cl.[6] ..... B41F 31/06; B41L 27/08

[52] U.S. Cl. ..... 101/363

[58] Field of Search ..... 101/207, 208, 101/209, 210, 363, 350, 364, 349, 148, 147, 340, 344, 347, 355, 356, 360, 366; 118/259, 261, 262

[56] References Cited

U.S. PATENT DOCUMENTS 4,414,897 11/1983 Sato et al. ..... 101/216
4,958,561 9/1990 Grosshauser .
5,005,476 4/1991 Kobler .
5,113,761 5/1992 Okamura ..... 101/350

FOREIGN PATENT DOCUMENTS 2909008 9/1980 Germany .
3737531 5/1989 Germany .
3800412 6/1991 Germany .
531572 1/1941 United Kingdom .

OTHER PUBLICATIONS

Patent Abstracts of Japan; No. 5–154995 (A); App. No. 4–98514; Dated Jun. 22, 1993.

*Primary Examiner*—J. Reed Fisher
*Attorney, Agent, or Firm*—Jones, Tullar & Cooper, P.C.

[57] ABSTRACT

A chamber doctor blade arrangement for a short inking unit utilizes an ink trough that supports a rotatable cylinder which supplies ink from the ink trough to a screen roller. One or more driven disks are situated in the ink trough beneath the rotatable cylinder. These disks aid in the mixing and distribution of the printing ink in the ink trough.

15 Claims, 2 Drawing Sheets

CHAMBER DOCTOR BLADE ASSEMBLY

FIELD OF THE INVENTION

The present invention is directed generally to a chamber doctor blade assembly. More particularly, the present invention is directed to a chamber doctor blade assembly for a short inking system. Most specifically, the present invention is directed to a chamber doctor blade assembly for a short inking system of a rotary printing press. The chamber doctor blade assembly utilizes two flexible doctor blades that are positioned in an ink trough. A rotatable cylinder is situated in the ink trough between the two doctor blades. One or more rotatable disks are situated in the ink trough beneath the rotatable roller. As the disks rotate, they keep the ink in the ink trough evenly distributed and constantly moving. These rotatable disks can be gear driven or can be provided with individual drive motors,

DESCRIPTION OF THE PRIOR ART

Shore inking systems are generally well known in the art. These systems typically utilize a screened surface roller to supply ink from an ink trough to a printing cylinder. The screen roller frequently is in surface contact with a cylinder that is located in the ink trough and whose job it is to provide a generally uniform layer of ink to the ink screen roller. This cylinder typically is supported for rotation in the ink fountain in an effort to supply a uniform ink coating to the screen surface roller. One prior art chamber doctor blade arrangement for a short inking system of a rotary printing press is shown in the German document No. DE 37 37 531 A1. In this prior art device, there is provided an ink circulation chamber which receives a rotatable cylinder. This cylinder is situated in the ink circulation chamber between spaced doctor blades having free ends that engage the surface of the screen roller.

These prior art chamber doctor blade arrangements have several limitations. One of these is a lack of consistent and uniform ink distribution on the rotatable cylinder that is located in the ink circulation chamber. Printing ink is apt to be thick and viscous. To insure that the ink coating is uniform on the ink chamber roller, the typical expedient is to supply an excess of ink to the chamber. This is wasteful of ink, is apt to cause ink splattering, and creates a resistance force to the rotation of the cylinder. In the situation where the ink being used is quite expensive due possibly to color or pigment, the operation of the chamber doctor blade arrangement in a conventional manner has been quite costly.

It will thus be seen that a need exists for a chamber doctor blade arrangement that overcomes the limitations of the prior art. The chamber doctor blade arrangement for a short inking system in accordance with the present invention provides such an arrangement and is a significant improvement over the prior art.

SUMMARY OF THE INVENTION

It is an object of the present invention to provide a chamber doctor blade arrangement.

Another object of the present invention is to provide a chamber doctor blade arrangement for a short inking unit.

A further object of the present invention is to provide a chamber doctor blade arrangement for a short inking unit in a rotary printing press.

Still another object of the present invention is to provide a chamber doctor blade arrangement which provides satisfactory mixing of the ink.

Even a further object of the present invention is to provide a chamber doctor blade that accomplishes even distribution of the ink on the screen roller.

Still yet another object of the present invention is to provide a chamber doctor blade arrangement which accomplishes even ink distribution and satisfactory mixing using little ink.

As will be discussed in detail in the description of the preferred embodiment which is presented subsequently, the chamber doctor blade arrangement in accordance with the present invention utilizes an ink trough which is provided with a rotatably supported cylinder whose axis is disposed generally parallel to the axis of rotation of the screen cylinder which it supplies ink to. The ink is situated in the ink trough and is caused to be circulated by one or more driven disks that are placed between the rotatable cylinder and a base of the ink trough. These disks rotate about disk axes of rotation that are generally perpendicular to the axes of rotation of the rotatable cylinder and of the screen roller. These disks keep the ink in the ink trough circulating because of their constant rotation.

The chamber doctor blade arrangement of the present invention has several advantages over the prior art arrangements. The driven disks or gear wheels that are placed adjacent the bottom of the ink trough cooperate with the rotating cylinder to insure that the printing ink in the ink trough is well mixed. They also insure that this well mixed ink is evenly distributed on the surface of the screen roller. Any tendency of the printing ink to adhere to the long sides of the chamber doctor blade arrangement is counteracted by the present invention. Additionally, the chamber doctor blade arrangement of the present invention allows the ink trough to operate with much less ink than would otherwise be required. This is particularly important when expensive, decorative inks are being used.

The chamber doctor blade arrangement for a short inking unit in accordance with the present invention overcomes the limitations of the prior art devices. It is a substantial advance in the art.

BRIEF DESCRIPTION OF THE DRAWINGS

While the novel features of the chamber doctor blade arrangement for a short inking unit in accordance with the present invention will be set forth with particularity in the appended claims, a full and complete understanding of the invention may be had by referring to the detailed description of the preferred embodiments which are presented subsequently, and as illustrated in the accompanying drawings, in which:

DETAILED DESCRIPTION OF THE PREFERRED EMBODIMENTS

Figure 1:
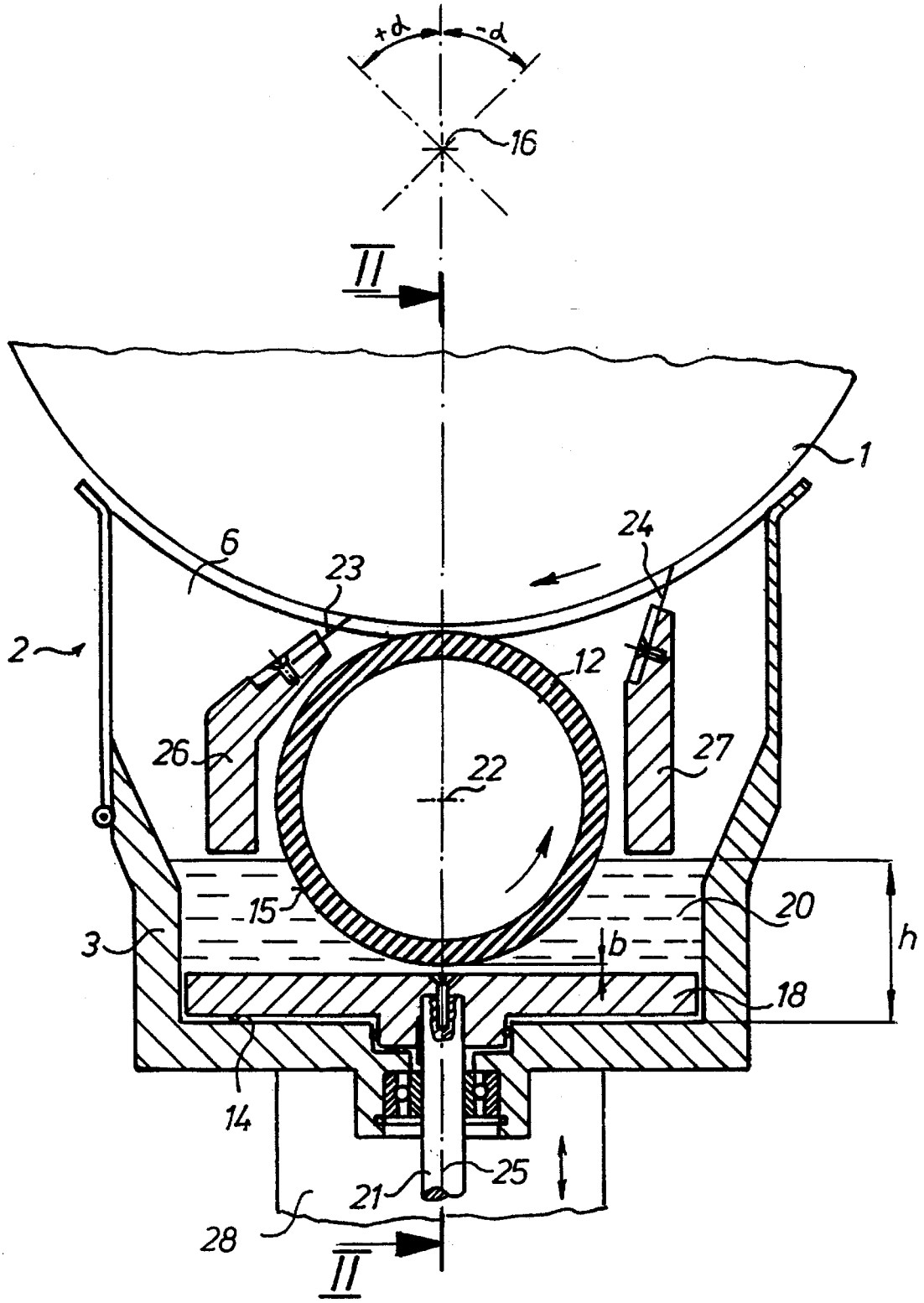
FIG. 1 is a cross-sectional view through a chamber doctor blade arrangement in accordance with the present invention.
Figure 2:
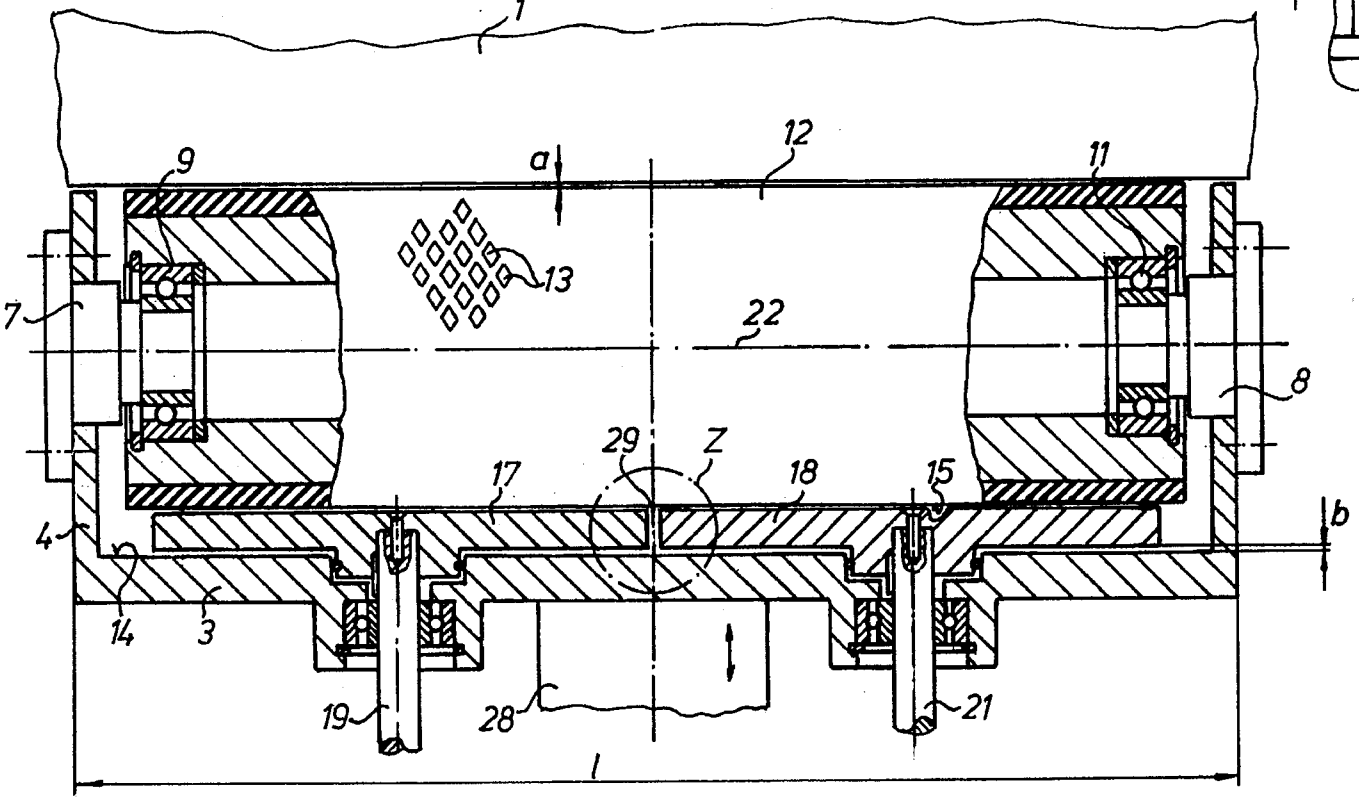
FIG. 2 is a side elevation view, partly in cross-section of the chamber doctor blade arrangement but with the doctor blades, their holders, and the printing ink not shown for ease of illustration.

Referring initially primarily to FIG. 1 and taken in conjunction with FIG. 2, there may be seen, generally at 2, a first preferred embodiment of a chamber doctor blade arrangement in accordance with the present invention. This chamber doctor blade arrangement 2 is usable to supply a printing ink 20 to the surface of a screen roller 1 that is part of a short inking system of a rotary printing press which is not depicted. It will be understood that the short inking unit and the printing press are of generally conventional construction and that they form no part of the present invention.

The chamber doctor blade arrangement, generally at 2, includes an ink trough 3 which is generally U-shaped in cross section and which has spaced side walls and a bottom surface 14. The ink trough 3 has an overall length "l", as seen in FIG. 2 and extends beneath and generally parallel to an axis of rotation 16 of the screen roller 1. The length "l" of the ink trough may be, for example, one quarter of the total length of the screen roller 1 so that four different ink troughs 2 can be situated below the screen roller 1. Each ink trough 1 is provided with end closure panels 4 and 6 at its axial ends, as seen in FIGS. 1 and 2. These end closure panels 4 and 6 may be attached to the ends of the ink trough 3 by suitable fasteners, such as screws. The upper edges of each of the end closure panels 4 and 6 are matched in shape to the peripheral shape or curvature of the screen roller 1.

A pair of shaft journals 7 and 8 are fastened or otherwise secured on the end closure panels 4 and 6 respectively, as is shown in FIG. 2. These shaft journals have a common axis of rotation that is parallel to the axis of rotation of the screen roller 1. A rubber cylinder, generally at 12 is supported for rotation on the shaft journals 7 and 8 by suitable bearing assemblies, generally at 9 and 11. This rotatable cylinder 12 rotates about its central axis of rotation 22 which is generally parallel to the axis of rotation 16 of the screen roller 1. The cylinder 12 is preferably provided with an outer covering of a resilient material, such as rubber. This rubber cover may be provided with an arrangement of surface projections 13 which can have a generally rhomboid shape, if desired. The resilient surface of the rubber cylinder 12 is located at a distance "a" with respect to the surface of the screen roller 1 which, as may be seen in FIG. 2 is a finite amount but which is small enough to let the rotatable cylinder 12 be driven by friction when the screen roller 1 rotates. This results in a film of the ink 20 to be transported being present between the rotatable cylinder 12 and the screen roller 1. It would also be possible to drive the rubber cylinder 12 by means of a suitable drive unit, such as by means of electric or other drive motors which are not specifically shown.

A plurality of driven disks, such as two driven disks 17 and 18 are located in the ink trough 3, generally adjacent the bottom surface 14 of the ink trough 3 and intermediate the trough bottom 14 and the rotatable rubber cylinder 12. Each of these driven disks 17 and 18 has a drive shaft 19 and 21, respectively. As is shown in both FIGS. 1 and 2, the axes of rotation 25 of these two drive shafts are generally perpendicular to, and pass through, the axes of rotation 22 and 16 of the rubber cylinder 12 and the screen roller 1, respectively. These two drive shafts 19 and 21 extend out from the bottom 14 of the ink trough 3 and can be connected to suitable drive sources located outside of the chamber doctor blade arrangement 2. These drives can be, for example, flanged to the outside of the bottom surface 14 of the ink trough 3.

Again referring to FIGS. 1 and 2, the rotatable or driven disks 17 and 18 are located just above the bottom or base 14 of the ink trough 3 and at a spacing distance "b" below the surface 15 of the rubber cylinder 12. This spacing distance "b" of the driven disks 17 and 18 can be set individually for each disk. It is also possible for this spacing distance "b" of the disks 17 and 18 from the rubber cylinder 12 to be set concurrently for both disks 17 and 18.

A pair of resilient doctor blades 23 and 24 are supported by spaced doctor blade holders 26 and 27, respectively, as may be seen most clearly in FIG. 1. Free ends of these doctor blades 23 and 24 are engageable with the surface of the screen roller 1 which, as seen in FIG. 1 is supported for rotation about its axis of rotation 16 in a clockwise direction. The doctor blade 23 is a working doctor blade while the doctor blade 24 is a contact or closing end doctor blade. Both of these doctor blades 23 and 24 extend the length of the ink trough 3 and their edges are generally parallel to the axis of rotation 18 of the screen roller 1. The doctor blades 23 and 24 are clamped or otherwise secured in the strip-shaped holders 26 and 27. Both ends of the strip-shape doctor blade holders 26 and 27 are interlockingly connected with the end closure panels 4 and 6 for the chamber doctor blade arrangement 2.

The two driveable disks 17 and 18 may be embodied as circular and can be provided with gear teeth about their peripheral edges. These disks 17 and 18 can also be provided with various through holes or bores that will prevent the collection or the entrapment of air, for example, between the lower side faces of the disks 17 and 18 and the bottom surface 14 of the ink trough 3.

The chamber doctor blade arrangement 2 is height adjustable with respect to the fixed screen roller 1. This height adjustment capability is depicted schematically in FIG. 2 by the provision of a generally conventional lifting and lowering device 28. A left upper side wall of the ink trough 3, as is shown in FIG. 1, can be pivotable to an open position. This will facilitate the filling or refilling of the printing ink 20 in the ink trough 3.

Figure 3:
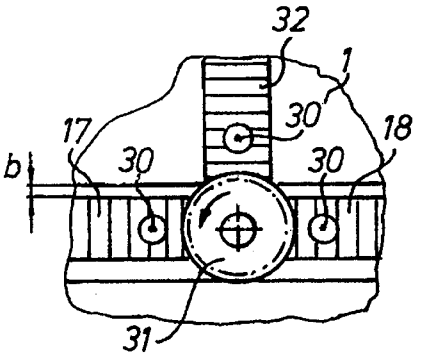
FIG. 3 is an enlarged detail view of the portion of FIG. 2 encircled at Z and showing an exemplary drive arrangement for the disks and rotatable cylinder.

In operation of the chamber doctor blade arrangement 2 in accordance with the present invention, in which the screen roller 1 is turning in the clockwise direction, as indicated by the arrow in FIG. 1, the rubber cylinder 12 will be caused to rotate in a counter-clockwise direction, either by frictional engagement with screen roller 1 or by a separate drive motor. The two disks 17 and 18 are driven through their respective drive shafts 19 and 21 so that they rotate in opposition to each other. This will cause the ink 20 in the ink trough 3 to be conveyed through a gap 29 between the two disks 17 and 18 with this gap 29 being shown in FIG. 2. This flow of ink, as seen in FIGS. 1 and 2, through the gap 29 will be in the direction of the longitudinal side of the ink trough 3 which has the contact or end closing doctor blade 24. The ink 20 is thus directed toward this wall by the disks 17 and 18 and is then conveyed by the rubber cylinder 12, which is rotating in the counter-clockwise direction up and toward the screen roller 1. The screen roller conveys the ink 20 toward the working doctor blade 23. Any excess ink removed by the working doctor blade 23 is returned to the ink trough 3 on the side of the trough adjacent the working doctor blade 23 so that the ink 20 is continually moving in a generally circular path. The directions of rotation of the disks 17 and 18 and of the rubber cylinder 12 are depicted in FIG. 3 by means of circles with dots. This circle-dot symbol 30 means that the part identified in this way moves out of the plane of the drawing sheet in the direction toward the viewer of the drawings.

The rubber cylinder 12 could also be supported and driven in a direction opposite to that of the screen roller 1. This would mean that the rubber cylinder 12 and the screen roller 1 could both rotate in the clockwise direction or could both rotate in the counter-clockwise direction. This would result in the formation of an ink bulge or ink bubble between the working doctor blade 23 and the point of cooperation between the rubber cylinder 12 and the screen roller 1, assuming clockwise rotation of both.

Both of the disks 17 and 18 could be provided as meshing gear wheels. In this configuration it would be appropriate to provide only one drive for these two disks. In accordance with a third embodiment of the invention, as depicted in FIG. 3, it would be possible to provide a worm-gear shaft 31 between the two disks 17 and 18 which would be provided with the gear teeth on their edges, as discussed above. This worm-gear shaft 31 would be situated adjacent the bottom 14 of the ink trough 3 and would be driven by an outside drive source. The worm-gear shaft 31 would further mesh with teeth 32 disposed in an annular band on the peripheral surface of the rubber cylinder 12. Thus the worm-gear shaft 31 could effect the rotation of both of the disks 17 and 18, as well as the rubber cylinder 12. The teeth 32 on the rubber cylinder 12 would be situated at approximately the mid-point of the axial length of the cylinder 12; i.e. at one half of the length "l" of the ink trough 3. These teeth 32 would not project radially out beyond the outer surface 15 of the rubber cylinder 12 and thus would not engage the surface of the screen roller 1.

While the chamber doctor blade arrangement in accordance with the present invention has been discussed as having two disks 17 and 18 disposed at the bottom of the ink trough 3, in is within the scope of the invention to provide more or fewer disks. For instance, it would be possible to provide only one disk 17 or 18 at the bottom 14 of the ink trough 3.

Referring again to FIG. 1, it is seen that the ink trough 3 is disposed generally perpendicularly below the axis of rotation 16 of the screen roller. This means that a center line 25 of the ink trough 3 would be generally vertical and would pass through the center of rotation 16 of the screen roller 1. It is also possible, in accordance with the present invention to pivot this center line 25 of the ink trough 3 so that it is no longer oriented vertically. As may be seen in FIG. 1, this center line 25 can be rotated through an angle $\alpha$ of generally +45° to −45°. This will result in the ink trough 3 being laterally situated on the screen roller 1. In this orientation, the drivable disks would dip only partially into the printing ink 20 in the ink trough 3.

It would also be possible, in accordance with another embodiment of the present invention, which is not shown in the drawings, to position a second cylinder, not shown, below and axially parallel with the rubber cylinder 12, at a distance "b" beneath the cylinder 12. This second cylinder would rotate in cooperation with cylinder 12 in a clockwise direction and could take the place of one or several driven disks, such as disks 17 and 18. The drive of this second cylinder could take place synchronously with the drive of the rotatable cylinder 12. The material and the surface of the second cylinder could be the same as that of the rotatable cylinder 12. Alternatively, this second cylinder could have a steel shell. The diameter of this second cylinder would not have to be the same as the diameter of the first cylinder. For example, if the second cylinder were to be rotated by frictional contact with the rotatable cylinder 12 it would be advantageous for this second cylinder to have a diameter less than that of the cylinder 12.

As depicted in FIG. 1, the printing ink 20 in the ink trough 3 would typically have a fill height between a quarter and a half of the diameter of the cylinder 12. This fill height could be varied in accordance with various factors such as the physical characteristics of the ink, its cost and the like.

While preferred embodiments of a chamber doctor blade arrangement for a short inking system in accordance with the present invention have been set forth fully and completely hereinabove, it will be apparent to one of skill in the art that a number of changes in, for example, the overall sizes of the various cylinders and rollers, the specific type of printing press being used, the nature of the printing ink and the like could be made without departing from the true spirit and scope of the present invention which is accordingly to be limited only by the following claims.

What is claimed is:

1. A chamber doctor blade arrangement for a short inking unit of a rotary printing press comprising:

an ink trough having a bottom, side walls and end walls;

a rotatable cylinder supported in said ink trough and having an axis of rotation; and a plurality of driven disks disposed in said ink trough generally adjacent said ink trough bottom and an a distance from said rotatable cylinder, said driven disks at least partially contacting ink in said ink trough.

2. The chamber doctor blade arrangement of claim 1 wherein said disks are circular.

3. The chamber doctor blade arrangement of claim 1 wherein said disks have through bores.

4. The chamber doctor blade arrangement of claim 1 further including rotary drive shafts for said driven disks, each of said drive shafts extending at right angles with respect to said axis of rotation of said rotatable cylinder.

5. The chamber doctor blade arrangement of claim 1 wherein said disks are provided as meshing gear wheels.

6. The chamber doctor blade arrangement of claim 5 further including an annular band of gear teeth on said rotatable cylinder generally at a midlength of said rotatable cylinder.

7. The chamber doctor blade arrangement of claim 6 further including a worm gear shaft engageable with said annular band of gear teeth and said gear wheels.

8. The chamber doctor blade arrangement of claim 1 wherein said rotatable cylinder has a rubber outer cover.

9. The chamber doctor blade of claim 8 further including projections on an outer surface of said rubber outer cover of said rotatable cylinder.

10. The chamber doctor blade arrangement of claim 1 further including a screen roller having a screen roller axis of rotation parallel to said axis of rotation of said rotatable cylinder and further wherein four of said chamber doctor blade arrangements are positioned adjacent to each other in an axial direction parallel to said screen roller axis of rotation and beneath said screen roller.

11. The chamber doctor blade arrangement of claim 1 wherein two of said driven disks are disposed adjacent each other in said ink trough.

12. The chamber doctor blade arrangement of claim 1 wherein a distance of said driven disks beneath said rotatable cylinder can be set independently for each said disk.

13. The chamber doctor blade arrangement of claim 1 wherein a distance of said driven disks beneath said rotatable cylinder can be set concurrently for all of said disks.

14. A chamber doctor blade arrangement for a short inking unit of a rotary printing press comprising:

an ink trough having a bottom, side walls and end walls;

a rotatable cylinder supported in said ink trough and having an axis of rotation; and a driven disk disposed in said ink trough generally adjacent said ink trough bottom and at a distance from said rotatable cylinder, said driven disk at least partially contacting ink in said ink trough.

15. The chamber doctor blade arrangement of claim 1 further wherein said ink trough is disposed beneath said screen roller.

* * * * *